United States Patent [19]

Blaser et al.

[11] 4,360,075

[45] Nov. 23, 1982

[54] LOW BACK PRESSURE EXHAUST SILENCER FOR DIESEL LOCOMOTIVES

[75] Inventors: Dwight A. Blaser, Sterling Heights, Mich.; David J. Goding, Willow Springs, Ill.; Karl U. Ingard, Kittery Point, Me.

[73] Assignee: General Motors Corporation, Detroit, Mich.

[21] Appl. No.: 262,464

[22] Filed: May 11, 1981

[51] Int. Cl.[3] ..... F01N 1/02; F01N 1/08

[52] U.S. Cl. ..... 181/250; 181/251; 181/273; 181/275

[58] Field of Search ..... 181/249, 250, 251, 224, 181/255, 266, 273, 275, 276

[56] References Cited

U.S. PATENT DOCUMENTS

| | | | |
|---|---|---|---|
| 1,874,326 | 8/1932 | Mason . | |
| 3,187,834 | 6/1965 | Bryson et al. . | |
| 3,382,948 | 5/1968 | Walker et al. | 181/250 |
| 3,503,465 | 3/1970 | Kobayashi et al. . | |
| 4,164,266 | 8/1979 | Collin et al. . | |
| 4,281,741 | 8/1981 | Blaser et al. | 181/250 |
| 4,287,962 | 9/1981 | Ingard et al. | 181/224 |

OTHER PUBLICATIONS

IAC Bulletin No. 4,1215.0, Industrial Acoustics Co. 1972.

*Primary Examiner*—L. T. Hix
*Assistant Examiner*—Thomas H. Tarcza
*Attorney, Agent, or Firm*—Robert J. Outland

[57] ABSTRACT

An exhaust silencer especially for turbo-charged diesel locomotives with a single exhaust outlet combines a straight through exhaust duct preferably diverging to recover velocity pressure and minimize back pressure with dual silencing means including a large expansion tank around the duct tuned to attenuate a fundamental low frequency exhaust noise peak and smaller reactive chambered means in the duct sized to attenuate a selected mid range of higher frequency exhaust noise. Various features are included.

4 Claims, 3 Drawing Figures

LOW BACK PRESSURE EXHAUST SILENCER FOR DIESEL LOCOMOTIVES

TECHNICAL FIELD

This invention relates to engine exhaust silencers and more particularly to a low back pressure silencer arrangement particularly applicable to turbocharged diesel locomotives.

BACKGROUND

U.S. patent application Ser. No. 80,475, now U.S. Pat. No. 4,281,741, filed Oct. 1, 1979, the disclosure of which is hereby incorporated by reference in the present application, contains a brief dicussion of earlier uses of locomotive exhaust silencers. This discussion includes reference to a silencer used with turbocharged diesel powered domestic road type locomotives having a single elongated exhaust outlet opening upwardly from the turbine. That silencer includes a dual bend offset outlet conduit that provides broad band sound reduction in the medium and high frequency range, combined with a large tank defined expansion chamber surrounding the lower portion of the outlet conduit and connected thereto by perforations through the conduit wall, so as to provide sound reduction in the lower frequency ranges.

Upon the release of an improved diesel locomotive providing for operation of the diesel engine at higher horsepower and speed, the above-described silencer arrangement was modified in order to maintain the engine exhaust noise level below established noise standards. Modifications included the provision of a sharper bend in the offset outlet conduit and the addition of increased communication between the conduit and the associated expansion chamber. While these changes satisfactorily controlled the increased exhaust noise level of the higher horsepower engine, they also had the effect of causing a slightly increased restriction to exhaust gas flow with a resultant adverse effect upon engine fuel efficiency.

Accordingly, it was desired to provide an improved engine silencer arrangement having the capability of maintaining exhaust noise within established standards while reducing exhaust back pressure to improve fuel efficiency.

SUMMARY OF THE INVENTION

The present invention provides a locomotive exhaust silencer applicable to turbocharged road type diesel locomotives of the type described. The new silencer provides a low back pressure exhaust restriction superior to either of the previously mentioned domestic locomotive silencer designs and providing substantially improved engine fuel efficiency.

A feature of the invention is that it includes a straight exhaust duct which avoids the dual bend configuration of the prior silencers and permits straight through flow of exhaust gases from the turbocharger outlet to atmosphere, thereby reducing exhaust back pressure.

A further feature of the invention is that the straight through exhaust duct is elongated to match the cross-sectional configuration of the turbocharger outlet and includes narrow sides connecting opposite wide sides that diverge in direction toward the duct outlet to recover velocity pressure and thus further minimize back pressure in the engine exhaust system.

Another feature of the invention is that it includes a large tank-like oval shaped expansion chamber surrounding the exhaust duct intermediate its ends and communicating therewith through a plurality of ports in the diverging opposite wide sides of the duct, the expansion chamber being tuned to respond to and attenuate a fundamental low frequency exhaust noise peak of the associated engine.

Yet another feature of the invention is that smaller reactive chambers are provided spaced within the exhaust duct and preferably also along the narrow sides thereof, the reactive chambers being covered by perforated walls. The internally spaced reactive chambers define divider means extending longitudinally and laterally between and connecting the opposite wide sides transversely of the duct to divide the duct into a plurality of straight parallel flow areas spaced across the width of the diverging opposite sides and communicating with the reactive chambers through the perforated walls. The reactive chambers are sized to attenuate a selected range of higher frequency engine exhaust noise than the fundamental frequency.

Still another feature of the invention is that the open outlet end of the straight through exhaust duct permits ease of inspection of the exhaust duct interior for the possible buildup of carbon deposits and, if necessary, for the cleaning of such deposits.

An optional feature of the invention is that the means defining the reactive chambers within the exhaust duct may be made removable from the silencer assembly for inspection, cleaning and replacement if desired.

These and other features and advantages of the invention will be more fully appreciated and understood from the following description of a preferred embodiment taken together with the accompanying drawing.

BRIEF DRAWING DESCRIPTION

DESCRIPTION OF THE ILLUSTRATED EMBODIMENT

Figure 1:
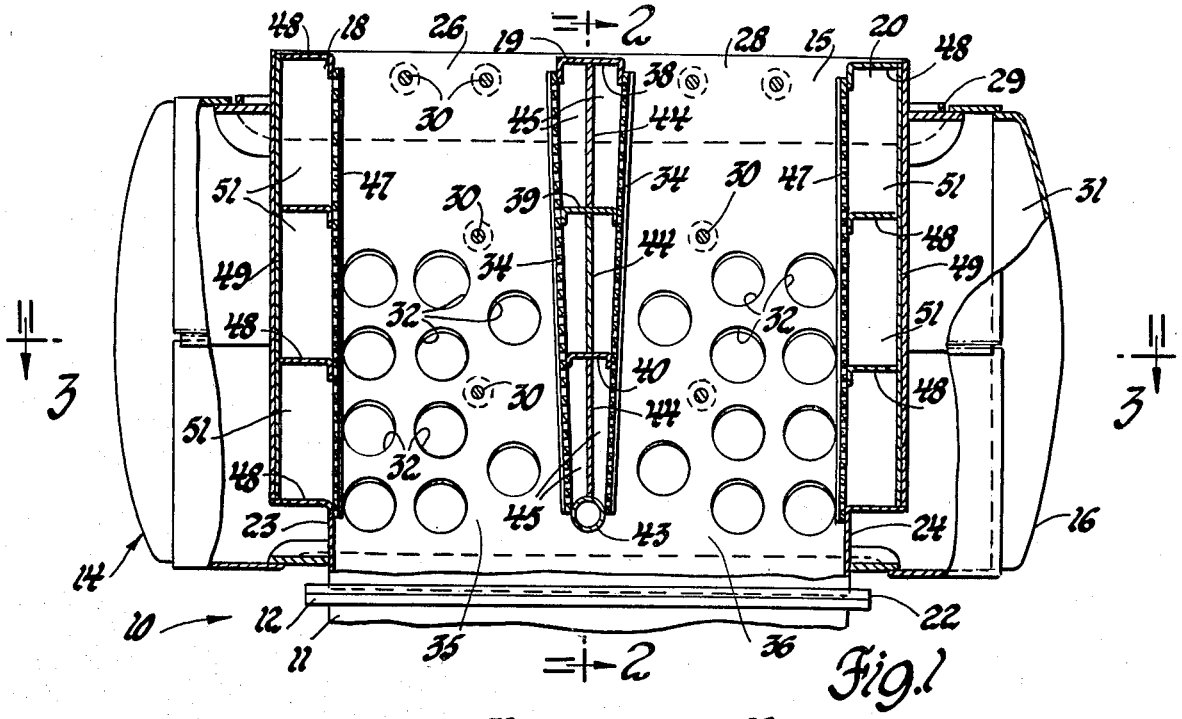
FIG. 1 is an elevational view from one side of a silencer in accordance with the invention having substantial portions broken away to show the interior construction, the silencer being mounted on the engine of a diesel locomotive as viewed from one end thereof.
Figure 2:
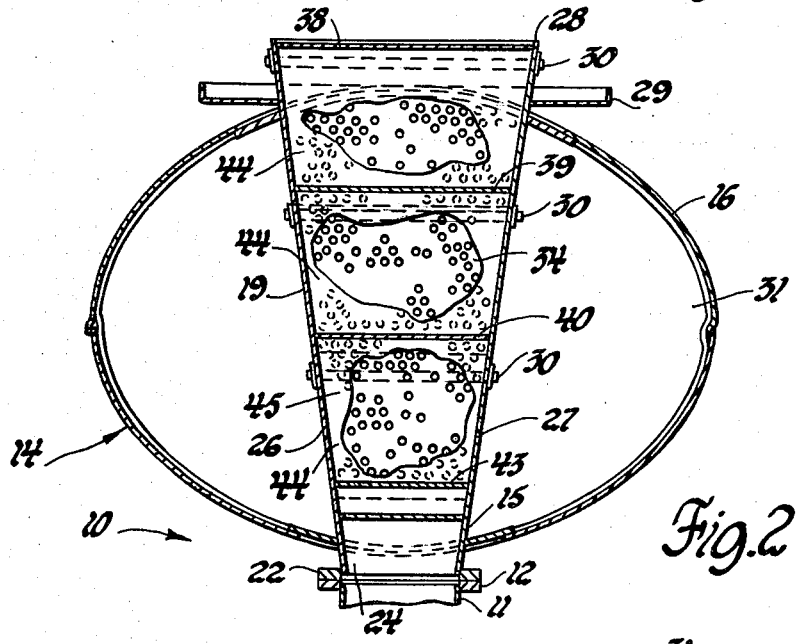
FIG. 2 is a transverse cross-sectional view through the silencer as seen from the plane indicated by the line 2—2 of FIG. 1.
Figure 3:
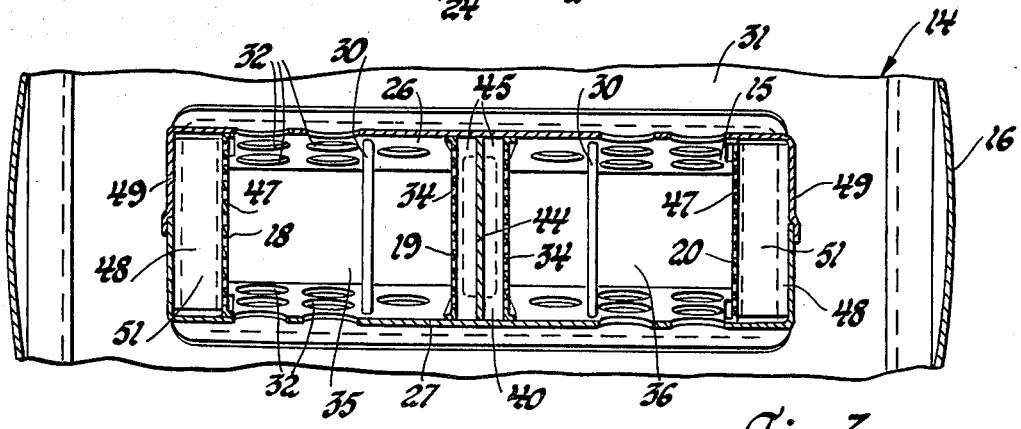
FIG. 3 is a horizontal cross-sectional view through the silencer taken in the plane generally indicated by the line 3—3 of FIG. 1.

Referring now to the drawing in detail, numeral 10 generally indicates a railway diesel locomotive powered by a turbocharged diesel engine having an exhaust system terminating in an elongated turbine exhaust outlet 11 provided with a mounting flange 12. Upon the flange 12 of the outlet 11, there is secured, by means not shown, a low back pressure exhaust silencer generally indicated by numeral 14.

Silencer 14 comprises a welded assembly of metal plates and sheets which for purposes of explanation is roughly separable into three major elements or portions. These include a straight through exhaust duct 15, a large expansion chamber defining tank 16, and chambered means 18, 19 and 20 defining a plurality of reactive chambers communicating with the duct 15.

The exhaust duct portion of the silencer assembly includes a bottom flange 22 defining the inlet end of the duct and secured, through means such as bolts not shown, to the outlet flange 12 of the engine turbocharger exhaust system. Flange 22 connects with four duct defining plates including oppositely disposed relatively narrow parallel end members 23 and 24 extending laterally between and connected to substantially wider oppositely disposed sides 26, 27. The wide sides 26, 27 diverge in the direction of exhaust flow from the inlet flange 22 to the upper outlet end 28 of the exhaust duct portion 15.

A collector pan 29 surrounds the duct near its outlet end 28 to intercept foreign matter such as rain and snow passing through the locomotive roof opening, not shown, through which the duct outlet protrudes. A drain, not shown, may be connected to the pan 29 to carry off collected fluids. A number of tie rods 30 extend across the duct between the opposite sides 26, 27 to stabilize and maintain the shape of the side plates under the varying temperature conditions encountered during operation.

The expansion tank 16 is made from a number of metal elements welded together to define an expansion chamber 31 surrounding a major portion of the duct 15 intermediate its inlet and outlet ends 22, 28 respectively. The interior of the duct communicates with the expansion chamber 31 through a plurality of ports or openings 32 which are provided in the diverging opposite wide sides 26, 27 of the duct portion 15. The length of the expansion chamber is selected to tune the chamber to the fundamental low frequency exhaust noise peak of the associated diesel engine, while the size of the chamber as well as the size and number of the ports 32 are selected to provide a desired degree of attenuation of the engine fundamental low frequency exhaust noise.

The chambered means 18, 19, 20 include both narrow side located elements 18, 20 and a central divider element 19. The latter includes a pair of longitudinally spaced perforated metal walls 34 extending longitudinally of the duct and laterally between and connecting with the wide side walls 26, 27 transversely of the duct to divide the duct into two straight parallel flow areas 35, 36, spaced side-by-side across the width of the two diverging wide sides of the duct. Walls 34 are spacedly connected by three horizontal separators 38, 39, 40, vertically spaced from one another and a tubular element 43 connected between the lower ends of the walls 34. Nonperforated center plates 44 extending vertically between the perforated walls 34 combine with the separators and tubular element to define a plurality of small reactive chambers 45 which communicate individually through the perforated walls 34 with their respective flow areas 35, 36 of the duct interior.

In like manner, the narrow side located chambered means 18 and 20 are formed by perforated walls 47 connected by spacers 48 to nonperforated back and side walls 49 to define a plurality of reactive chambers 51 that communicate with their respective adjoining straight parallel flow areas 35, 36 of the duct interior through the perforated walls 47.

The reactive chambers are variously sized, though much smaller than the expansion chamber, and are disposed to react with and attenuate a selected range of higher frequency engine exhaust noise above the fundamental frequency attenuated by the tuned chamber and covering a relatively broad spectrum of moderate noise frequencies in which reduction of exhaust noise is desirable. The reactive chambers thus combine with the relatively large tuned expansion chamber to provide a broad range of sound attenuation covering both the fundamental noise peak of the associated engine and a broader spectrum of higher frequency noise associated with the engine exhaust system.

In addition to providing adequate silencing of the turbocharged diesel engine exhaust noise, the silencer of the present invention accomplishes this while minimizing the exhaust back pressure placed on the engine by the silencing device. This is accomplished first by the straight through character of the silencer exhaust duct 15 which does not require a substantial change in direction of the exhaust gas flow leaving the turbocharger exhaust outlet in order to pass through the silencer. In addition, further reduction of back pressure is obtained by the diverging character of the exhaust duct. This is provided by the diverging wide sides 26, 27 which are configured to allow a gradual expansion of the exiting exhaust gases so as to recover velocity pressure therein. Such pressure recovery minimizes the back pressure at the silencer inlet and will actually provide a negative static pressure at the outlet of the turbocharger exhaust system where it connects with the silencer inlet when operating at rated exhaust flow.

The design of the exhaust silencer with its wide open outlet end 28 of the exhaust duct provides for ease of inspection by operating personnel of the condition of the duct interior. In particular, direct observation may be made from the locomotive roof, not shown, into the open duct end to determine whether there is any substantial buildup of carbon or other deposits on the perforated sides 26, 27 of the duct or the perforated walls 34 and 47 covering the reactive chambers. If necessary, accumulated deposits may be cleaned from the surfaces while the silencer remains in place.

Experience so far indicates that substantial accumulations of deposits are not likely to become a significant problem in normal locomotive operation. However, should such deposits require repetitive servicing under certain conditions of operation not currently anticipated, it is within the scope of the present invention to construct the chambered means 18, 19 and 20 as separate elements which may be separately installed in and removed from the silencer assembly. Thus, elements which have collected excessive accumulations of deposits may be removed and replaced by clean elements and the removed elements may be subsequently cleaned in a more convenient location for subsequent reuse.

While the invention has been described by reference to certain preferred embodiments chosen for purposes of illustration, it should be understood that numerous changes could be made within the spirit and scope of the invention concepts described. Accordingly it is intended that the invention not be limited to the described embodiments but that it have the full scope permitted by the language of the following claims.

The embodiments of the invention in which an exclusive property or privilege is claimed are defined as follows:

1. A low back pressure exhaust silencer for turbocharged diesel locomotives, said silencer comprising a straight exhaust duct having inlet and outlet ends connected by walls including two opposite sides, expansion chamber defining means adjacent said duct and communicating therewith through a plurality of ports in said opposite sides, said expansion chamber means being tuned to respond to and attenuate a fundamental low frequency exhaust noise peak of the associated engine, and means defining reactive chambers covered by perforated walls in said duct, said reactive chamber means defining divider means extending longitudinally of the duct and laterally between and connecting said opposite sides transversely of the duct to divide said duct into a plurality of straight parallel flow areas, each communicating with said expansion chamber through said sides and with a portion of said reactive chambers through said perforated walls, said reactive chambers being sized to attenuate a selected range of higher frequency engine exhaust noise.

2. A low back pressure exhaust silencer for turbocharged diesel locomotives having a single elongated exhaust system outlet, said silencer comprising a straight exhaust duct of elongated cross-sectional configuration and having an inlet end connectable with said exhaust system outlet, an outlet end spaced from said inlet end and walls connecting said ends including two opposite relatively wide sides connected at their edges by opposed narrower sides, said wide sides diverging in direction toward said outlet end to recover velocity pressure and thereby minimize back pressure in the exhaust system at said duct inlet end, expansion chamber means defining a large expansion chamber surrounding said duct intermediate its ends and communicating therewith through a plurality of ports in said diverging opposite wide sides, said chamber being tuned to respond to and attenuate a fundamental low frequency exhaust noise peak of the associated engine, and means defining relatively small reactive chambers covered by perforated walls within said duct, said reactive chamber means defining divider means extending longitudinally of the duct and laterally between and connecting said opposite wide sides transversely of the duct to divide said duct into a plurality of straight parallel flow areas spaced across the width of said opposite wide sides and each communicating with said expansion chamber through said wide sides and with a portion of said reactive chambers through said perforated walls, said reactive chambers being sized to attenuate a selected range of higher frequency engine exhaust noise.

3. The silencer of claim 2 and further comprising means defining reactive chambers adjacent the narrower sides at the edges of and extending laterally between said diverging opposite wide sides of said duct to supplement the noise attenuation of said flow area dividing reactive chamber means.

4. The silencer of either of claims 2 or 3 wherein said reactive chamber defining means are removable from said silencer for cleaning through the open outlet end of said duct.

* * * * *

UNITED STATES PATENT AND TRADEMARK OFFICE

CERTIFICATE OF CORRECTION

PATENT NO. : 4,360,075

DATED : November 23, 1982

INVENTOR(S) : Dwight A. Blaser, David J. Goding, Karl U. Ingard

It is certified that error appears in the above-identified patent and that said Letters Patent are hereby corrected as shown below:

Column 1, line 16, "dicussion" should read -- discussion --.

Column 3, line 7, "end" should read -- side --.

Column 3, line 9, after "The" insert -- latter --.

Signed and Sealed this

Eighth Day of March 1983

[SEAL]

Attest:

GERALD J. MOSSINGHOFF

Attesting Officer

Commissioner of Patents and Trademarks